US007931437B1

(12) United States Patent
Johnson

(10) Patent No.: US 7,931,437 B1
(45) Date of Patent: Apr. 26, 2011

(54) TURBINE CASE WITH INLET AND OUTLET VOLUTES

(75) Inventor: Gabriel L. Johnson, Port St. Lucie, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 877 days.

(21) Appl. No.: 11/903,560

(22) Filed: Sep. 21, 2007

(51) Int. Cl.
*F01D 1/02* (2006.01)

(52) U.S. Cl. ..... 415/184; 415/189; 415/191; 415/205; 415/208.1; 415/219.1; 415/220

(58) Field of Classification Search ..... 415/183, 415/184, 189, 191, 203, 204, 205, 219.1, 415/220, 224.5, 208.1
See application file for complete search history.

(56) References Cited

U.S. PATENT DOCUMENTS 2,189,106 A * 2/1940 Garve et al. ..... 60/612
2,671,406 A * 3/1954 Waller ..... 415/205
3,289,598 A 12/1966 Buse et al.
3,734,650 A * 5/1973 Reisacher et al. ..... 417/407
4,213,742 A 7/1980 Henshaw
4,850,797 A * 7/1989 Benson ..... 415/205
5,286,162 A 2/1994 Veres
5,580,214 A * 12/1996 Mohn ..... 415/64
6,120,246 A * 9/2000 Auger et al. ..... 415/205
6,302,647 B1 * 10/2001 Schueler et al. ..... 415/184
7,014,418 B1 3/2006 Arnold et al.

* cited by examiner

*Primary Examiner* — Igor Kershteyn
(74) *Attorney, Agent, or Firm* — John Ryznic

(57) ABSTRACT

A one piece axial flow turbine case with an inlet volute and an outlet volute with an axial flow turbine positioned between the inlet and outlet volutes, in which the turbine vanes and blades can be installed or removed from one side of the case without disassembling the two volutes. The one piece turbine case eliminates the mating flange, the flange seal, and the flange bolts required in the two piece turbine volute case. The one piece axial flow turbine case reduces the part count, reduces the weight of the turbine, improves the reliability of the turbine, and improved the performance of the turbine. The annular guide vane assembly with an annular outer shroud having guide vanes extending from the shroud is inserted through an opening of the turbine case. The vane outer shroud extends aft to form an outer shroud for the turbine blades.

19 Claims, 5 Drawing Sheets

TURBINE CASE WITH INLET AND OUTLET VOLUTES

FEDERAL RESEARCH STATEMENT

The US Government has a paid-up license in this invention and the right in limited circumstances to require the patent owner to license others on reasonable terms as provided for by the terms of Contract No. FA9300-04-C-0008 awarded by the United States Army.

CROSS-REFERENCE TO RELATED APPLICATIONS

This application is related to U.S. application Ser. No. 11/486,703 filed on Jul. 14, 2006 by Gabriel L. Johnson and entitled VOLUTE WITH CUT-BACK AT TRANSITION, the entire disclosure of which is incorporated herein by reference.

BACKGROUND OF THE INVENTION

1. Field of the Invention

The present invention relates generally to fluid turbines, and more specifically to a fluid turbine case.

2. Description of the Related Art Including Information Disclosed Under 37 CFR 1.97 and 1.98

A turbine casing, such as that used in a turbo-pump for a rocket engine, includes an axial flow turbine positioned between a tangential flow inlet pipe and a tangential flow outlet pipe. Each of the tangential flow inlet and outlet pipes transitions into a volute to take the tangential flow fluid into an axial flow fluid passing into or discharging from the axial flow turbine. The prior art turbine case includes at least two pieces with the inlet volute being one piece and the outlet volute being the other piece, and the axial flow turbine being positioned between the inlet volute and the outlet volute.

In the prior art two piece volute case, the inlet case and the inlet vanes must be assembled either before or after the exit case with the turbine blades trapped in the middle. In order to remove the turbine blades, the two piece volute case of the prior art must be disassembled.

It is another object of the present invention to provide for a turbine case with an inlet volute and an outlet volute in which the turbine rotor disk and blades can be removed without disassembling the volute case.

BRIEF SUMMARY OF THE INVENTION

A one piece axial flow turbine case with an inlet volute and an outlet volute with an axial flow turbine positioned between the inlet and outlet volutes, in which the turbine vanes and blades can be installed or removed from one side of the case without disassembling the two volutes. The one piece turbine case eliminates the mating flange, the flange seal, and the flange bolts required in the two piece turbine volute case. The one piece flow turbine case reduces the part count, reduces the weight of the turbine, improves the reliability of the turbine, and improved the performance of the turbine. The one piece volute case can be used for an axial or a radial flow turbine.

The annular guide vane assembly with an annular outer shroud having guide vanes extending from the shroud is inserted through an opening of the turbine case. The vane outer shroud extends aft to form an outer shroud for the turbine blades.

DETAILED DESCRIPTION OF THE INVENTION

Figure 1:
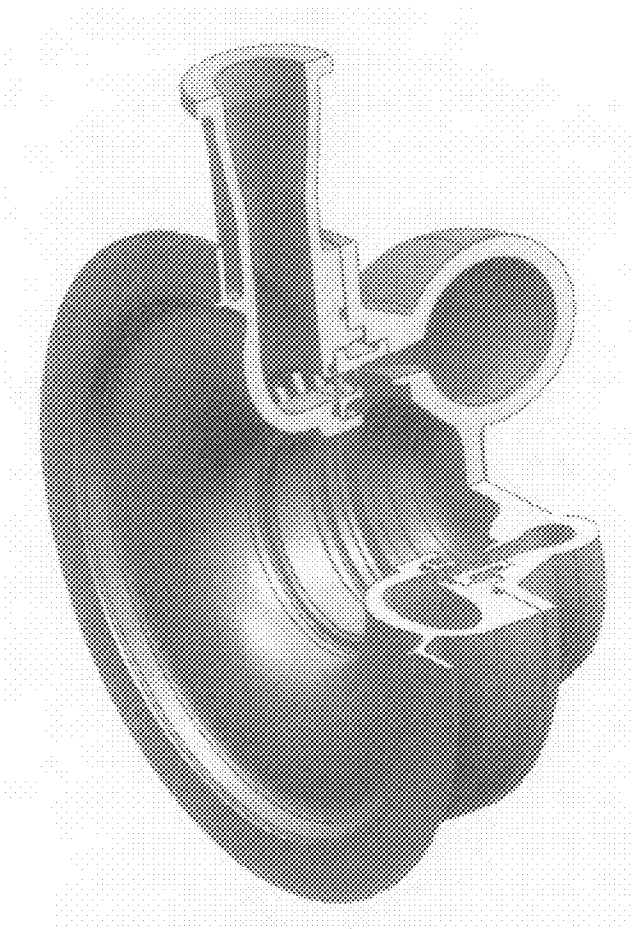
Fig 1 Prior art
FIG. 1 shows a prior art axial flow turbine case with separate inlet volute and outlet volute.
Figure 2:
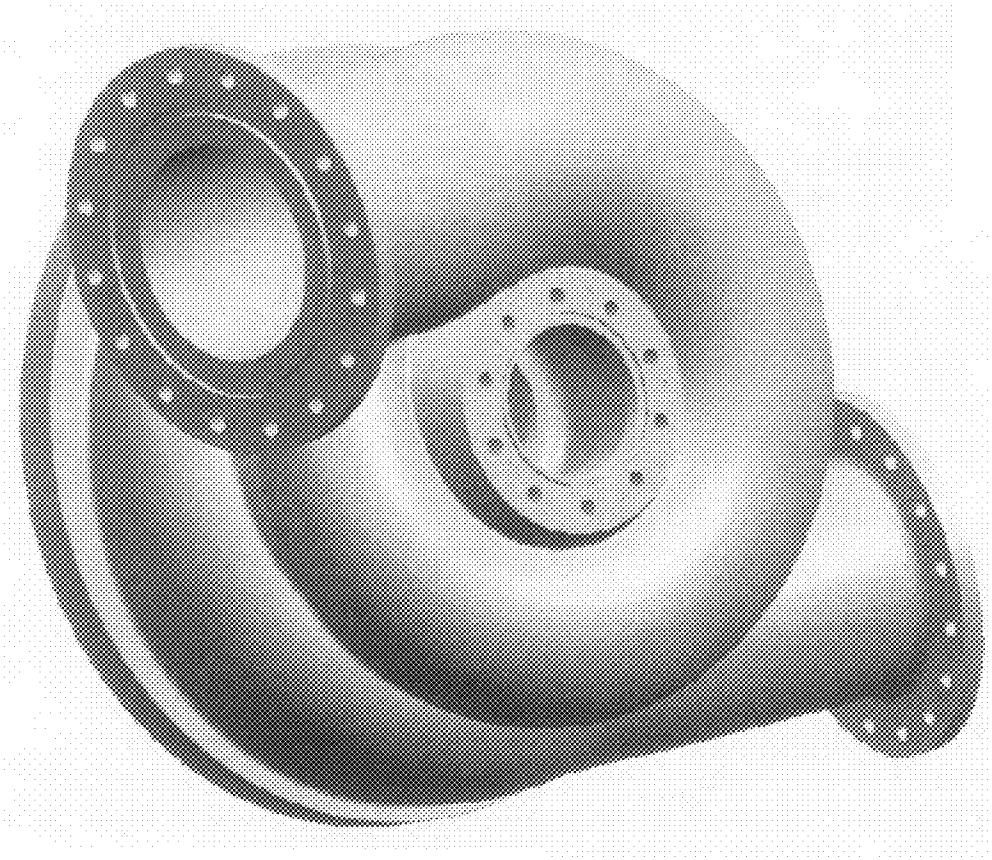
FIG. 2 shows a schematic view of the single piece axial flow turbine case of the present invention.
Figure 3:
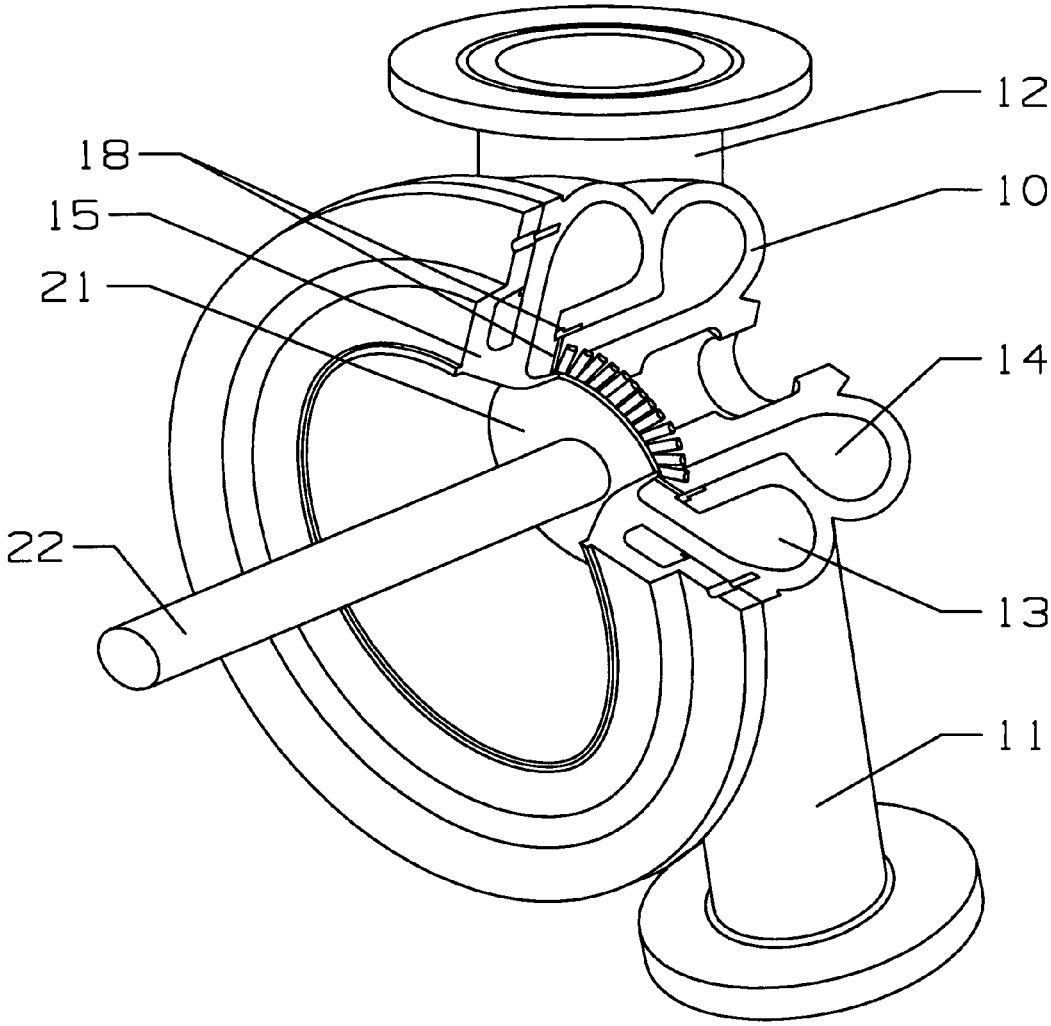
FIG. 3 shows a schematic view with a cutaway view of the one piece axial flow turbine case of the present invention.

The present invention is a axial or radial flow turbine with a tangential inlet and a tangential outlet in which the turbine case 10 is formed of a single piece with an inlet volute and an outlet volute positioned on the sides of the axial flow turbine. FIG. 3 shows a cut-away view of the turbine case 10 with an inlet pipe 11 and an outlet pipe 12, an inlet volute 13 and an outlet volute 14, an axial flow turbine disk with turbine blades extending from the disk 21, turbine inlet guide vanes 18, and a turbine rotor shaft 22 connected to the turbine disk 21. An fluid flows into the inlet pipe 11, passes through the inlet guide vanes 18, reacts with the turbine blades to drive the rotor shaft 22, and exits through the outlet volute 14 and then the outlet pipe 12. The volutes are well known in the art for converting a circumferential flow into an axial flow or an axial flow into a circumferential flow. A vane ring case 15 has the guide vanes formed as an integral piece and is secured to the one piece turbine case 10 by a number of bolts 16.

In the present invention, the inlet pipe and volute and the outlet pipe and volute are formed as a single cast piece in order to eliminate the mating flange, the flange seal, and the flange bolts of the prior art turbine case. A contoured tongue or cut-back (not shown) is also used to reduce the rotor side loads.

Figure 4:
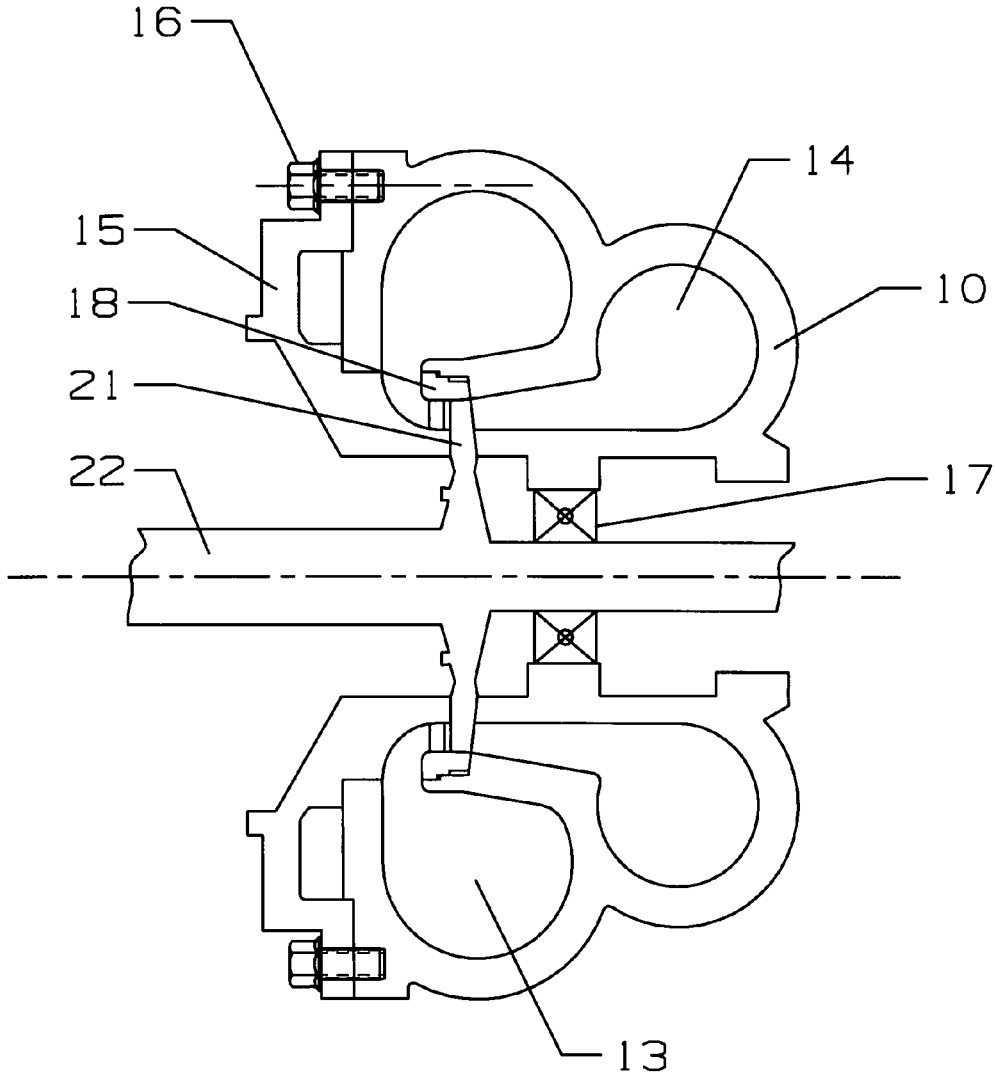
FIG. 4 shows a cross section view of the single piece turbine case with an axial flow turbine of the present invention.

FIG. 4 shows a cross section view of the turbine case 10 of the present invention with the single piece turbine case 10 having the inlet volute 13 and the outlet volute 14 with an opening on the left side of the figure to insert the turbine disk and blades. The first embodiment shows the opening in the turbine case 10 to be formed on the left side of FIG. 3. However, the opening could also be formed on the right side with modifications to the volutes and flow passages within the turbine case 10. The rotor shaft 22 is supported by bearings 17 that are supported on an inner surface of the turbine case 10. Other arrangements for the bearings can be used in order to support the rotor shaft of the turbine without departing from the spirit and scope of the present invention. The turbine blades 21 extend from a turbine rotor disk and into the path formed between the inlet volute 13 and the outlet volute 14. A vane ring casing 15 closes the opening in the one piece turbine case 10 after the turbine disk and shaft assembly has been inserted into the one piece turbine case 10. The guide vane assembly 18 is also secured onto the inside of the turbine case upstream from the turbine blades.

Figure 5:
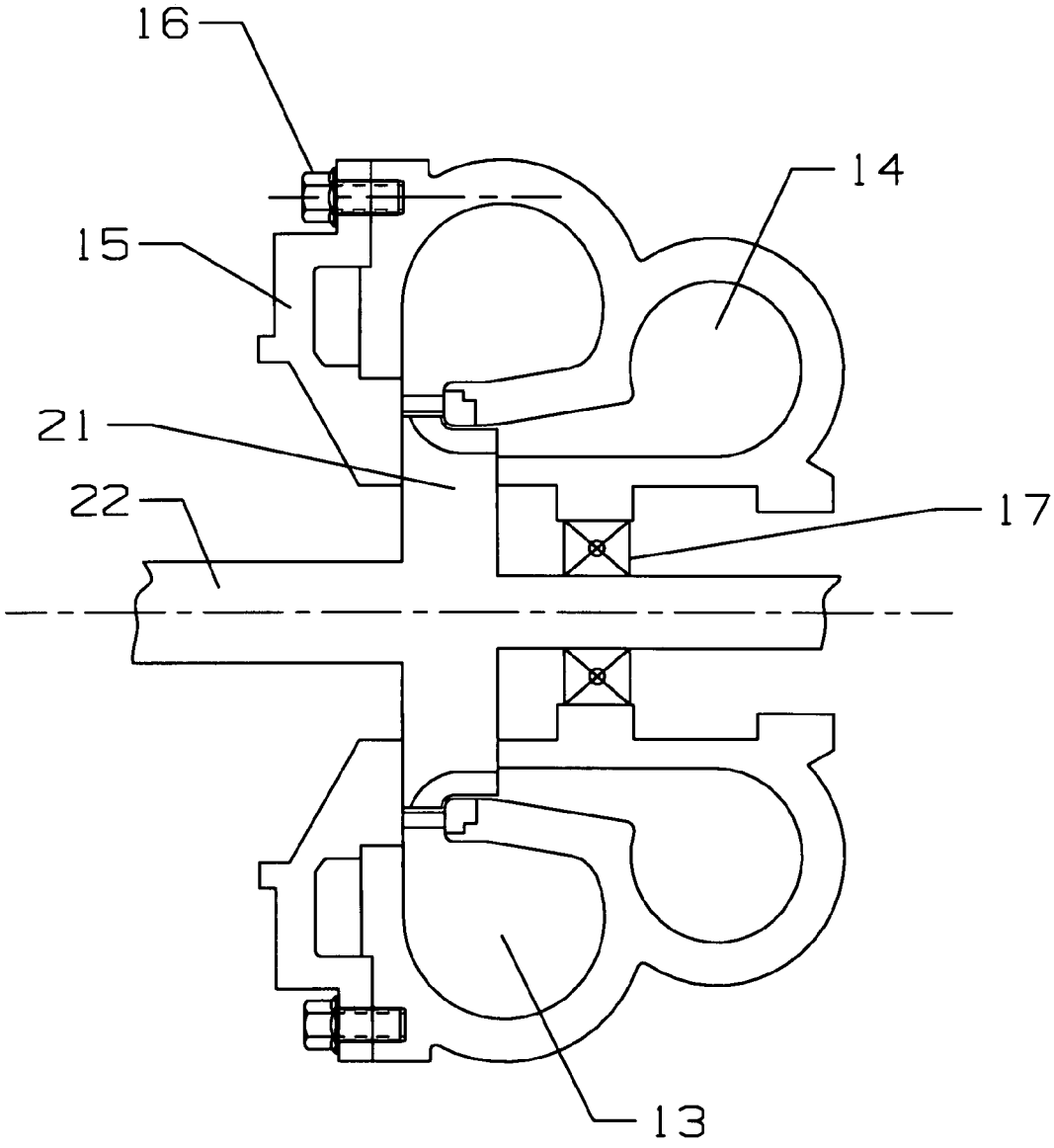
FIG. 5 shows a cross section view of the single piece turbine case with a radial flow turbine of the present invention.

FIG. 5 shows another embodiment of the present invention in which the one piece turbine case 10 is used with a radial flow turbine instead of the axial flow turbine of the first embodiment of FIGS. 3 and 4 described above. In FIG. 5, the rotor disk 21 includes radial flow turbine blades 31 downstream of a turbine inlet guide vane arrangement 38 such that fluid flows from the inlet volute 13 in a radial inward direction and through the turbine blades into the outlet volute 14 in an axial direction. With this arrangement, the rotor disk and radial flow turbine blades 31 can also be inserted into the opening within the side of the one piece turbine case 10 and closed by the inlet guide vane casing 15.

A cut-back is formed in each of the inlet and the outlet volutes at the transition surface between the pipe and the volute to eliminate the abrupt transition in the volute as described in the pending application Ser. No. 11/486,703 filed on Jul. 14, 2006 by Gabriel L. Johnson and entitled VOLUTE WITH CUT-BACK AT TRANSITION. The cut-back increases the fluid dynamic performance of the volute by reducing the loses in the fluid flow and improves the structural durability of the volute by reducing the stress in the transition, and also simplifies the ability to fabricate the volute by allowing for casting due to eliminating the abrupt transition piece. By eliminating the abrupt transition, the thick to thin material gradient is reduced in the part, and therefore the ability of a liquid metal to pore during casting is improved, resulting in the metal to reach all the desired locations completely. This also allows for the cast part to cool more evenly which reduces the chance of defects in the casting.

In both embodiments (axial flow and the radial flow turbines), the guide vanes can be formed as part of the casing 15 that encloses the turbine rotor disk within the one piece turbine case 10, or can be a separate piece secured to the one piece turbine case 10 and separate from the casing 15. It is preferred that the inlet guide vanes are formed as an integral part of the inlet guide vane casing 15 in order to eliminate any gap between the vanes and the inner or outer shrouds in which the vanes extend between in the flow path through the guide vanes. This integral vane and casing assembly will also add structural strength to the guide vane assembly.

When the guide vane case 15 is secured to the turbine case 10 by the plurality of bolts, an annular slot is formed between the turbine case 10 and the vane guide case 15 in which the turbine rotor disk rotates. The annular slot is sized so that a minimal amount of fluid will leak out from the turbine case. Seals are used to form a seal between the rotating turbine disk and the stationary cases to further reduce the flow leakage.

I claim the following:

1. A turbine case for an axial or radial flow turbine, the case comprising:

an inlet volute;

an outlet volute;

a turbine with a plurality of blades positioned between the inlet volute and the outlet volute in a fluid path;

the turbine case being formed as a single piece;

a case to enclose the axial flow turbine within the single piece turbine case; and, the turbine being an axial flow turbine.

2. The turbine case of claim 1, and further comprising:

an opening on one side of the turbine case, the opening being sized such that the turbine rotor disk and blades can be inserted into the turbine case opening.

3. The turbine case of claim 1, and further comprising:

the turbine being a radial flow turbine.

4. The turbine case of claim 1, and further comprising:

an inlet pipe leading into the inlet volute;

an outlet pipe leading from the outlet volute; and, the inlet pipe and the outlet pipe being offset at around 180 degrees.

5. A turbine case for an axial or radial flow turbine, the case comprising:

an inlet volute;

an outlet volute;

a turbine with a plurality of blades positioned between the inlet volute and the outlet volute in a fluid path; and, a guide vane case having a guide vane assembly integral with the case, the guide vane case forming a closed fluid passage between the inlet volute and the outlet volute.

6. The turbine case of claim 5, and further comprising:

the guide vane case including an outer shroud extending from the guide vanes, the outer shroud fitting within an annular grove formed on the turbine case and forming part of the flow path between the inlet volute and the outlet volute.

7. The turbine case of claim 5, and further comprising:

the guide vane case being an annular shaped case with an outer diameter and an inner diameter forming a central opening, the inner diameter being sized to allow for the turbine rotor disk and blades to fit within.

8. The turbine case of claim 7, and further comprising:

the inner diameter of the guide vane case being substantially equal to an inner diameter of the turbine case on the outlet volute end.

9. The turbine case of claim 5, and further comprising:

the guide vane case includes an inner surface that forms a portion of the flow path for the fluid from the inlet volute to the outlet volute.

10. The turbine case of claim 5, and further comprising:

the turbine case including an extension that separates the inlet volute from the outlet volute, the extension including an annular groove on an inner side of the end of the extension; and, the vane guide assembly including an outer shroud that fits within the annular groove to form a portion of the flow path between the inlet volute and the outlet volute.

11. The turbine case of claim 10, and further comprising:

the turbine case extension forms part of a diffuser formed between the turbine and the outlet volute.

12. The turbine case of claim 5, and further comprising:

the guide vane case forms an annular slot formed between the turbine case when the guide vane case is secured to the turbine case, the annular slot being sized to fit the turbine rotor disk with a minimal amount of fluid leakage across the turbine.

13. A turbine case for an axial or radial flow turbine, the case comprising:

an inlet volute;

an outlet volute;

a turbine with a plurality of blades positioned between the inlet volute and the outlet volute in a fluid path; and, the turbine case includes a diffuser formed between the turbine and the outlet volute such that the fluid exiting the turbine is diffused before passing into the outlet volute.

14. The turbine case of claim 13, and further comprising:

the diffuser extends substantially in an axial direction of the turbine rotation.

15. An axial flow turbine, comprising:

an inlet volute;

an outlet volute; an axial flow turbine positioned between the inlet volute and the outlet volute in the fluid flow path; and, the inlet volute and the outlet volute being formed as a single piece turbine case.

16. The axial turbine of claim 15, and further comprising:

the axial flow turbine case having an opening on one end, the opening being sized to allow for the turbine rotor disk and blades to fit within the opening.

17. An axial or radial flow turbine, comprising:

an inlet volute;

an outlet volute;

a turbine positioned between the inlet volute and the outlet volute in the fluid flow path;

the inlet volute and the outlet volute being formed as a single piece turbine case;

the turbine case having an opening on one end, the opening being sized to allow for the turbine rotor disk and blades to fit within the opening; and, a guide vane case having a guide vane assembly integral with the case, the guide vane case being secured to the turbine case and forming a portion of the flow path between the inlet volute and the outlet volute.

18. An axial or radial flow turbine, comprising:

an inlet volute;

an outlet volute;

a turbine positioned between the inlet volute and the outlet volute in the fluid flow path;

the inlet volute and the outlet volute being formed as a single piece turbine case; and the turbine case forming a diffuser between the turbine and the outlet volute.

19. The axial or radial flow turbine of claim 18, and further comprising:

the diffuser extending substantially in a direction of the rotational axis of the turbine.

* * * * *

UNITED STATES PATENT AND TRADEMARK OFFICE

CERTIFICATE OF CORRECTION

PATENT NO. : 7,931,437 B1
APPLICATION NO. : 11/903560
DATED : April 26, 2011
INVENTOR(S) : Gabriel L. Johnson It is certified that error appears in the above-identified patent and that said Letters Patent is hereby corrected as shown below:

Col. 1, Line 6, please replace with the following new paragraph:

-- This invention was made with Government support under contract number FA9300-04-C-0008 awarded by the US Air Force. The Government has certain rights in the invention. --.

Signed and Sealed this
Tenth Day of July, 2012

David J. Kappos

David J. Kappos
*Director of the United States Patent and Trademark Office*